US007125332B2

(12) United States Patent
Beaver et al.

(10) Patent No.: US 7,125,332 B2
(45) Date of Patent: Oct. 24, 2006

(54) CEILING RADIATION DAMPER AND MOUNTING METHOD

(75) Inventors: Michael Robert Beaver, Keller, TX (US); Patrick Alan Cockrum, Westlake, TX (US)

(73) Assignee: PCI Industries, Inc., Fort Worth, TX (US)

( * ) Notice: Subject to any disclaimer, the term of this patent is extended or adjusted under 35 U.S.C. 154(b) by 0 days.

(21) Appl. No.: 10/746,012

(22) Filed: Dec. 23, 2003

(65) Prior Publication Data

US 2005/0136829 A1 Jun. 23, 2005

(51) Int. Cl.
*A62C 2/12* (2006.01)

(52) U.S. Cl. ..... 454/369; 454/257

(58) Field of Classification Search ..... 454/369, 454/257, 357; 169/42
See application file for complete search history.

(56) References Cited

U.S. PATENT DOCUMENTS 3,169,007 A * 2/1965 Duffy et al. ..... 248/343
3,236,171 A * 2/1966 Vaskov et al. ..... 49/51
3,327,984 A * 6/1967 Rennie ..... 248/343
3,760,708 A * 9/1973 Burup ..... 454/267
3,985,158 A * 10/1976 Felter ..... 138/149
4,122,762 A * 10/1978 Williams ..... 454/292
4,271,751 A * 6/1981 Timmons ..... 454/292
4,293,895 A * 10/1981 Kristofek ..... 362/147
4,406,216 A * 9/1983 Hott et al. ..... 454/349
4,501,194 A * 2/1985 Brown ..... 454/354
4,510,851 A * 4/1985 Sarnosky et al. ..... 454/346
4,512,356 A * 4/1985 Widerby ..... 137/75
4,625,626 A * 12/1986 Aalto et al. ..... 454/369
4,717,099 A * 1/1988 Hubbard ..... 248/57
4,760,981 A * 8/1988 Hodges ..... 248/57
4,779,518 A * 10/1988 Artwick et al. ..... 454/353
4,858,520 A * 8/1989 Prochnow et al. ..... 454/292
5,060,901 A * 10/1991 Lathrop et al. ..... 248/343
5,238,220 A * 8/1993 Shell et al. ..... 251/67
5,316,254 A * 5/1994 McCartha ..... 248/343

* cited by examiner

*Primary Examiner*—Derek S. Boles
(74) *Attorney, Agent, or Firm*—Koppel, Patrick & Heybl

(57) ABSTRACT

A ceiling damper system that comprises a damper housing having an input opening to accept air from a heating, ventilation and air conditioning HVAC system, and an output opening to supply the HVAC air to a room. The system further comprises a damper mechanism to substantially block the flow of air through the damper housing when the temperature around the housing reaches a predetermined level. Two or more cross members are included, each of which is mounted between fixed points in the ceiling in a position to allow the cross members to support and hold the damper housing. The damper housing rests on the cross members and is mounted to the cross members. A method for mounting a ceiling damper that comprises providing a ceiling damper having a damper housing for accepting air from a HVAC system and providing the HVAC system air to a room. It further comprises mounting at least two cross members across fixed points in a room ceiling in a position to support the damper housing. It then comprises arranging the damper housing on the cross members so that the damper rests on the cross members and is affixed to the cross members in a position to provide HVAC air to the room. HVAC system air is then provided to the ceiling damper.

19 Claims, 4 Drawing Sheets

FIG. 4
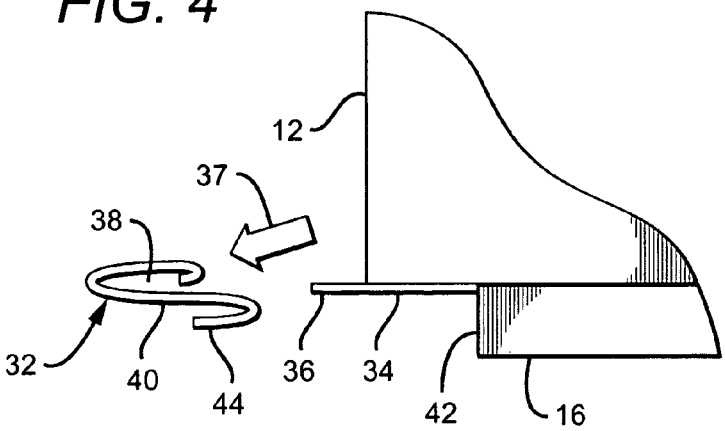
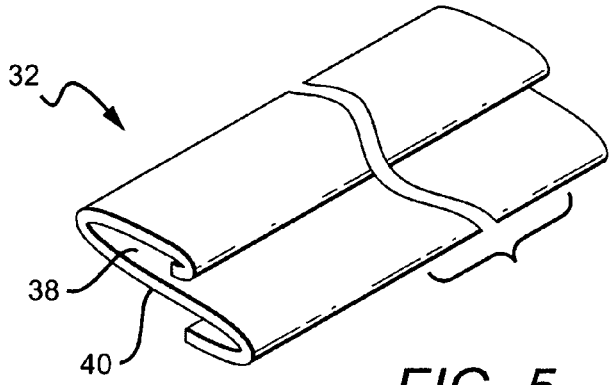
FIG. 5
FIG. 6
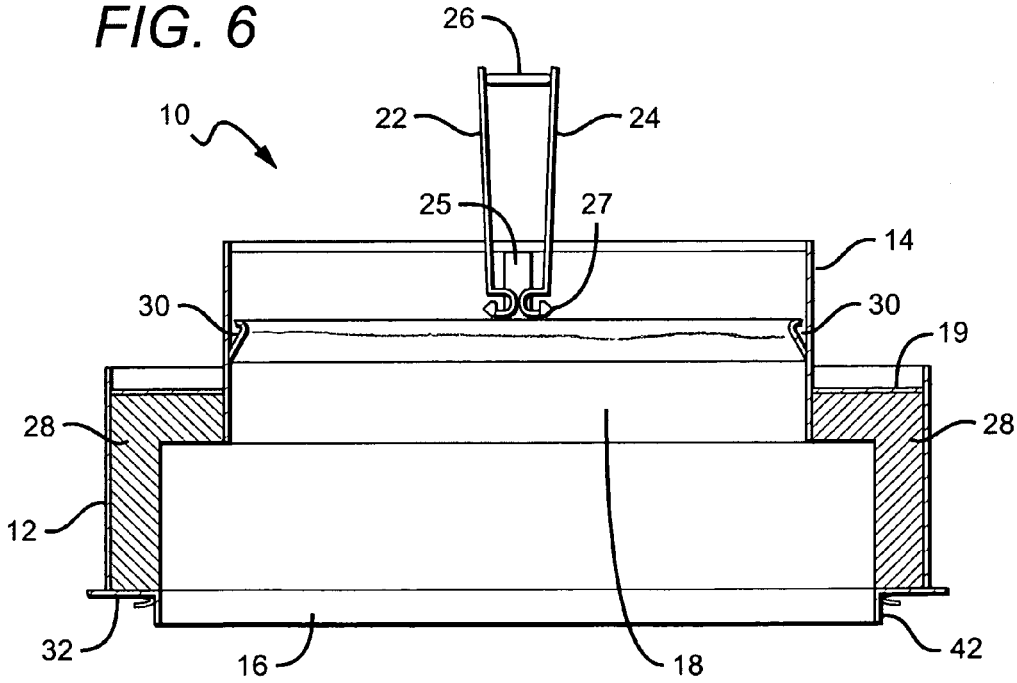

FIG. 7
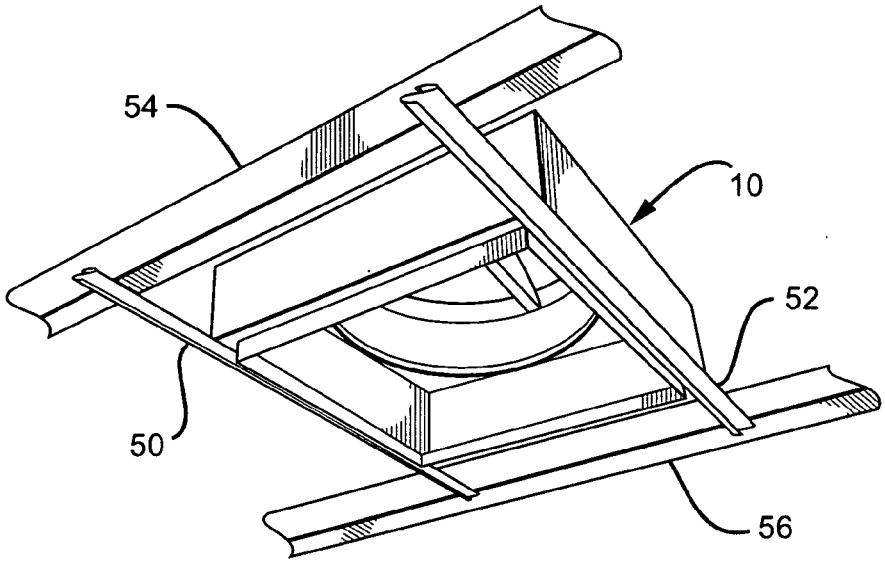
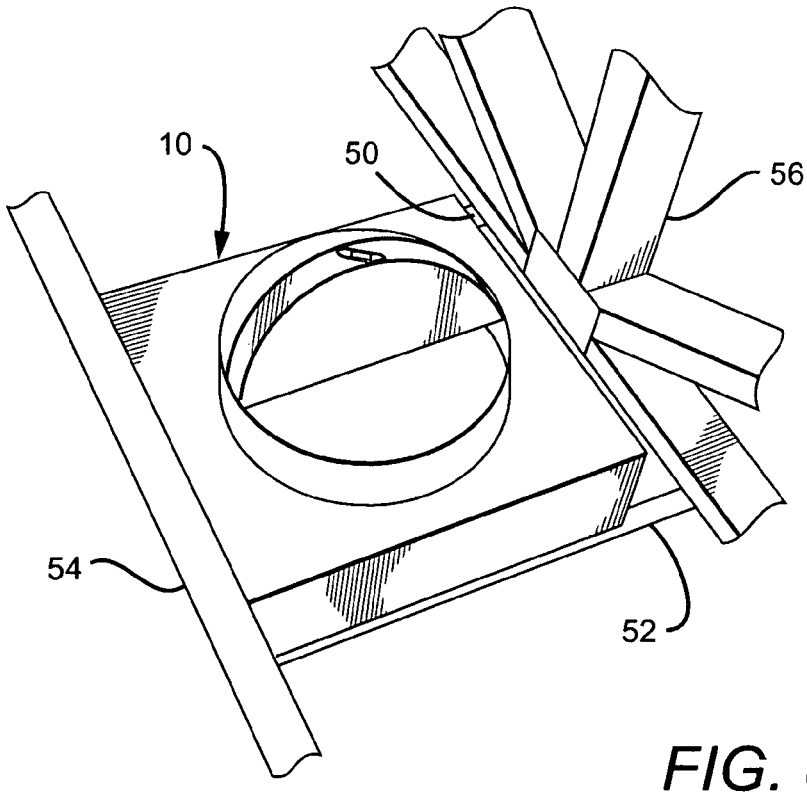
FIG. 8

CEILING RADIATION DAMPER AND MOUNTING METHOD

BACKGROUND OF THE INVENTION

1. Field of the Invention

This invention relates to dampers and more particularly to fire dampers mounted in ceilings.

2. Description of the Related Art

A major consideration in the design of commercial and residential buildings is the spread of fire and smoke in the event that a fire breaks out within the building. The walls and ceilings within the buildings serve as the primary barriers to the spread of fire and are most effective if they have no breaks or openings.

Most buildings have heating, ventilation, and air conditioning (HVAC) systems that distribute conditioned/heated air throughout the building by air ducts. The ducts carrying either heated or cooled air are directed to various rooms in the building and the air enters the rooms through openings or vents in the ceilings, floors or walls. These openings and vents, however, penetrate the ceiling, floors or walls, providing a hole that reduces the ability to prevent the spread of fire and smoke. To address this problem, dampers are often provided in the ducts or at the openings and vents that allow air to pass when open, but block airflow, flames, and hot gasses when closed. At elevated temperatures (such as in the case of fire) the dampers automatically close, effectively closing the duct and vent holes and restoring the full integrity of the fire and/or smoke barrier.

One type of conventional ceiling damper used in ceilings, can be arranged between components of the ceiling, such as trusses, joists and TJI beams (referred to collectively as "trusses"). The damper is mounted in the ceiling by a hanging arrangement wherein two or more wires, or some other similar hardware, are connected between the top of the damper and a fixed point above the damper. Ceiling material is mounted to the trusses and serves as the ceiling for the room, with the damper mounted between the ceiling and the top of the structure. The output of the damper is disposed in a hole in the ceiling material and the input is coupled to an HVAC system such that air from the HVAC system passes through the damper and into the room when the damper is open.

The damper can be hung in the ceiling using many different methods, with a typical method comprising mounting a horizontal angle or wood support stud between adjacent trusses, near the top of the trusses, with the support stud providing a fixed point for connection. The damper is then hung from the horizontal angle or wood support stud by two or more vertical angles or hanger wires that are connected between the damper and the horizontal support stud.

One disadvantage of hanging a damper in a ceiling is that the ceiling area between the trusses is small. It can be awkward and difficult to install the horizontal angle and wood stud support between the trusses and then hang the damper vertical angles or wires in such a small area. It is also difficult to cut the vertical angles or wires and connect them at the correct length so that the opening of the damper is at the same level as the ceiling material. If the damper is hung at the wrong level, the vertical angles or wire must be adjusted until the hanging height is correct. This can require repeatedly working the small ceiling area between the trusses until the damper is properly installed.

SUMMARY OF THE INVENTION

The present invention provides a ceiling damper system that allows a damper to be mounted in a ceiling without hanging and provides a method for installing a ceiling damper without hanging. One embodiment of a ceiling damper system according to the present invention comprises a damper housing having an inlet opening to accept air from a heating, ventilation and air conditioning (HVAC) system, and an outlet opening to supply the HVAC air to a room. The system further comprises a damper mechanism to substantially block the flow of air through the damper housing when the temperature around the housing reaches a predetermined level. Two or more cross members are included, each of which is mounted between fixed points in the ceiling. The cross members are arranged to support and hold the damper housing such that the damper housing rests on the cross members and is mounted to the cross members.

One embodiment of a method for mounting a ceiling damper according to the present invention comprises providing a ceiling damper having a damper housing for accepting air from a HVAC system and providing the HVAC system air to a room. It further comprises mounting at least two cross members across fixed points in a room ceiling in a position to support the damper housing. The damper housing is arranged on the cross members so that the damper rests on the cross members and is affixed to the cross members in a position to provide HVAC air to the room. HVAC system air is then provided to the ceiling damper.

These and other further features and advantages of the invention will be apparent to those skilled in the art from the following detailed description, taken together with the accompanying drawings, in which:

BRIEF DESCRIPTION OF THE DRAWINGS

FIG. 4 is an elevation view of the lower left portion of the damper in FIG. 1, with a boot rail;

FIG. 5 is a perspective view of one embodiment of a boot rail according to the present invention;

FIG. 6 is a sectional view of the damper in FIG. 1, taken along section lines 6—6;

FIG. 7 is a bottom perspective view of one embodiment of a damper according to the present invention installed in a ceiling using boot rails;

FIG. 8 is a top perspective view of the damper shown in FIG. 7;

DETAILED DESCRIPTION OF THE INVENTION

Figure 1:
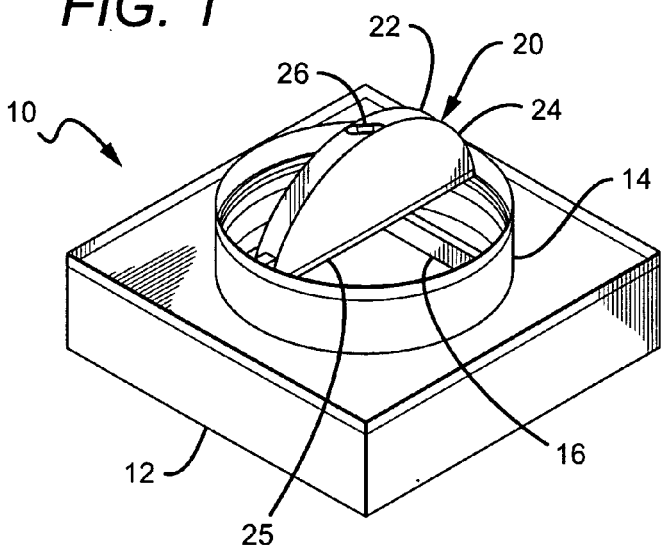
FIG. 1 is a perspective view of one embodiment of a damper according to the present invention.
Figure 2:
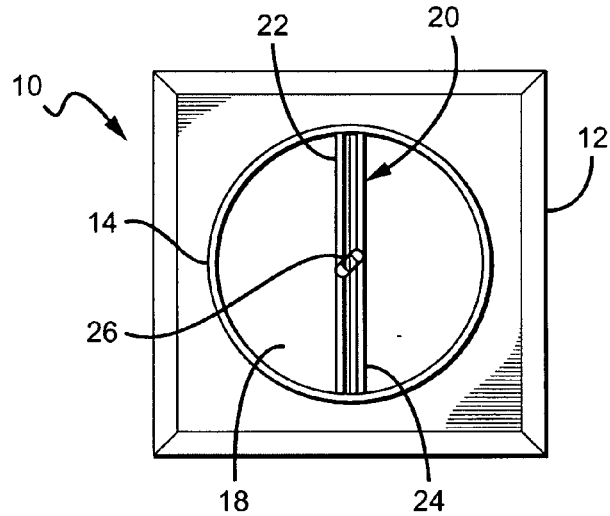
FIG. 2 is a top view of the damper shown in FIG. 1.

FIGS. 1–3 and 6 show one embodiment of a damper 10 that can be used in a ceiling damper system according to the present invention. It should be understood that the invention could also be used with many different types of dampers having different shapes and sizes. The damper 10 generally comprises a box shaped lower section 12 and a cylindrical upper damper frame 14. The lower section 12 and upper damper frame 14 can be made of many different rigid materials, with a suitable material being galvanized steel that is approximately 30 GA. The lower section 12 may have a rectangular or square shaped horizontal cross section.

The lower section 12 has a square/rectangular shaped opening 16 in its bottom surface 17 and a circular opening 18 in its top surface 19. The circular opening 18 can be in different locations on the top surface 19, with a suitable location having the center of the opening 18 aligned with the center of the top surface 19. The cylindrical damper frame 14 has substantially the same diameter as the circular opening 18 and the damper frame 14 is mounted to the top surface of the lower section 12, in alignment with the circular opening 18. The damper frame 14 opens to the interior of the lower section 12 through the circular opening 18.

A spring loaded butterfly blade mechanism 20 is mounted within the damper frame 14 and generally comprises two half circle damper butterfly blades 22, 24. The blades 22, 24 can be made of many different rigid materials, with a preferred material being galvanized steel that is approximately 22 GA. The radius of each of the half circles is substantially the same and when added together approximately equal the diameter of the upper damper frame 14. The straight base sections of each of the blades are rotatably mounted to a cross section 25 (shown in FIGS. 1 and 6) such that each of the blades 22, 24 can be rotated between a horizontal and vertical position, with the blades 22, 24 in the vertical position in FIGS. 1–3 and 6. Alternative dampers according to the present invention can comprise a single damper blade or more than two damper blades.

A closure spring 27 (shown in FIG. 6) is included at the base of each of the blades 22, 24 that urges the blades 22, 24 to the horizontal position. Many different springs can be used, with a preferred spring being a conventional zinc plated closure spring. When the blades 22, 24 are in a horizontal position they form a circle that substantially covers the opening of the damper frame 14, blocking most air from passing. When the blades 22, 24 are held in the vertical orientation, the damper is "open" and air is allowed to pass through it. When they are in the horizontal position, the damper is "closed" and air is prevented from passing.

As shown in FIGS. 1–3 and 6, the damper blades 22, 24 are held in a vertical "open" orientation by a fuse link 26 mounted between the top of the two blades 22, 24. Fuse links are commercially available and are typically held together by a section that melts at a predetermined temperature such that the fuse link separates into two pieces. The fuse link 26 is arranged between the blades 22, 24 with each of the blades 22, 24 connected to a respective one of two pieces of the fuse link 26. At the predetermined ambient temperature, the melting section melts, and the fuse link separates into two pieces. The blades are then no longer held in vertical orientation by the fuse link 26 and the closure spring 25 causes the blades 22, 24 to rotate to the horizontal orientation.

In other embodiments, the fuse link can be positioned in different locations and more than one fuse link can be used. In still other embodiments other devices other than a fuse link can be used which separate a predetermined temperature. Many different commercially available fuse links can be used according to the present invention, with a suitable fuse link provided by Elsie Manufacturing, Inc, Model B. This fuse link has a melting temperature in the range of 165 to 212 degrees Farenheit, although other fuse links with other separation temperatures can be used.

Referring now to FIG. 6, the interior of the lower section 12 can be covered by a layer of thermal insulation 28 that helps maintain the temperature of the air passing through the damper. Different types of insulation material can be used, with a suitable material being fiberglass R-6.0 insulation that is approximately 1½ inches thick. The inside of the cylindrical damper frame 14 can include a blade ledge 30 that runs axially around the inside surface of the cylindrical damper frame 14. The ledge 30 is at substantially the same height as the bottom of the vertically damper blades 22, 24. When the fuse link 26 separates and the blades 22, 24 are moved to the horizontal orientation by the damper spring, the outside edge of the blades 22, 24 rest on the ledge 30. The ledge 30 helps insure that when the fuse link 26 is separated, the blades 22, 24 come to rest in a horizontal orientation. The ledge also helps to block air from passing through any space that may be between the outer edge of the blades 22, 24 and the inside surface of the damper frame 14.

Figure 3:
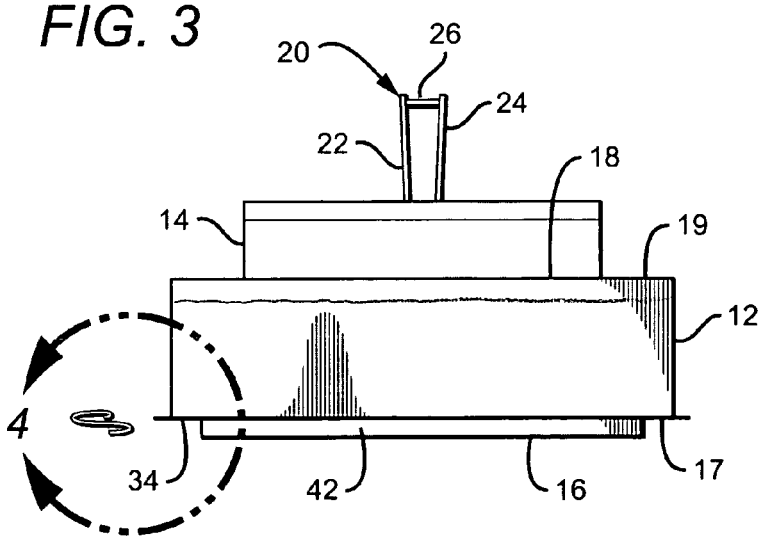
FIG. 3 is an elevation view of the damper shown in FIG. 1.

Referring now to FIGS. 3 through 5, a damper 10 according to the present invention can be mounted in a ceiling by attachments at the bottom of the damper's lower section 12, instead of being hung in place. Accordingly, when installing the damper 10, the hardware to hang the damper does not need to be installed in the confined area of the ceiling between the trusses. Instead, the installation hardware can be installed at the bottom of the trusses, which can be reached from the interior of the room where the space is generally not confined.

The damper 10 can be mounted from the bottom in many different ways using many different mechanisms according to the present invention. Any rigid cross-member can be used that can be mounted to fixed points in the ceiling so that the lower section can rest on the cross members without interfering with the flow of HVAC air in or out of the damper. The cross-member should also comprise a mechanism for holding the damper on the cross members.

A suitable cross member according to the present invention comprises an elongated boot rail 32 that is arranged to cooperate with the bottom surface 17 of the lower section 12. The boot rail 32 can be mounted in many different ways such as between adjacent trusses, joists or TJI beams (referred to collectively as "trusses") in a ceiling. As more fully described below, at least two boot rails 32 are needed for the mounting of each damper. After the boot rails 32 are mounted to the damper 10, the damper is mounted in the ceiling.

The square/rectangular opening 16 in the lower section's bottom surface 17 is smaller than the bottom surface 17 so that there is a boot flange 34 between the edge of the opening 16 and the bottom surface's edge. An edge lip 36 is also included around the bottom surfaces edge that extends horizontally from the boot flange 34. The boot rail 32 has a generally S-shaped cross section and when mounting the damper 10 on the boot rail, the edge lip 36 is inserted into and fits within the boot rail's first curved section 38 in the direction as shown by arrow 37. With boot rails on at least two opposing sides of the lower section 12, the damper 10 is held between the boot rails with the opposing edge lips 36 held in their respective first curved section 38. The boot flange 34 rests on the boot rail's flat section 40. The outside surface of the lower section 12 butts against the boot rail's first section 38.

A vertical hood 42 is included around the square opening 16 and when ceiling material is installed the edge of the opening in the ceiling material abuts the hood 42 with the bottom edge of the hood 42. The bottom opening and its hood should be flush with the ceiling material when the damper is installed. When the boot rails are installed, the hood 42 of the opening 16 rests against the boot rails second curved section 44.

FIGS. 7 and 8 show the damper 10 mounted on first and second boot rails 50, 52 that are affixed between first and second ceiling trusses 54, 56. The damper 10 should be supported by at least two boot rails with the ends of the boot rails 50, 52 connected to the trusses. Many different attachment devices can be used such as nails, screws or bolts, with suitable nails being 16*d* nails, suitable screws being No. 8 screws, and suitable bolts being 2 inches long. One or more of these mounting devices can be used at each end of the boot rails 50, 52. The boot rails 50, 52 can be mounted to many different locations on the trusses, with a suitable location as shown in FIGS. 7 and 8 being the lower surface of each of the trusses. The boot rails 50, 52 can also be mounted at different angles in relation to the trusses 54, 56 with a suitable angle being transverse to the trusses 54, 56.

The boot rails 50, 52 should be positioned on the trusses 54, 56 so that the first sections (shown in FIG. 4) of the boot rails can mate with the lip and flange of the damper's lower section to hold the damper. When the damper is installed, the lip (also shown in FIG. 4) along one edge of the lower section mates with the first boot rail 50 and the lip on the lower sections opposite edge mates with the second boot rail 52. The boot flange along these opposite lower section edges rest on their respective first or second boot rails 50, 52. This arrangement allows the first and second boot rails 50, 52 to hold the damper in place by the connection at the bottom of the damper to the boot rails 50, 52.

The damper 10 can be placed on the boot rails 50, 52 after they are installed or the boot rails 50, 52 can be positioned on the damper 10 first and then the boot rails 50, 52 can be mounted to the trusses. Alternatively, one of the boot rails can be mounted to one of the trusses and the second boot rail can be position on the damper 10. The damper can then be placed on the mounted first boot rail and the second boot rail can be mounted in place to one of the trusses. There can be many different variations of these mounting procedures depending on the number of boot rails used.

Figure 9:
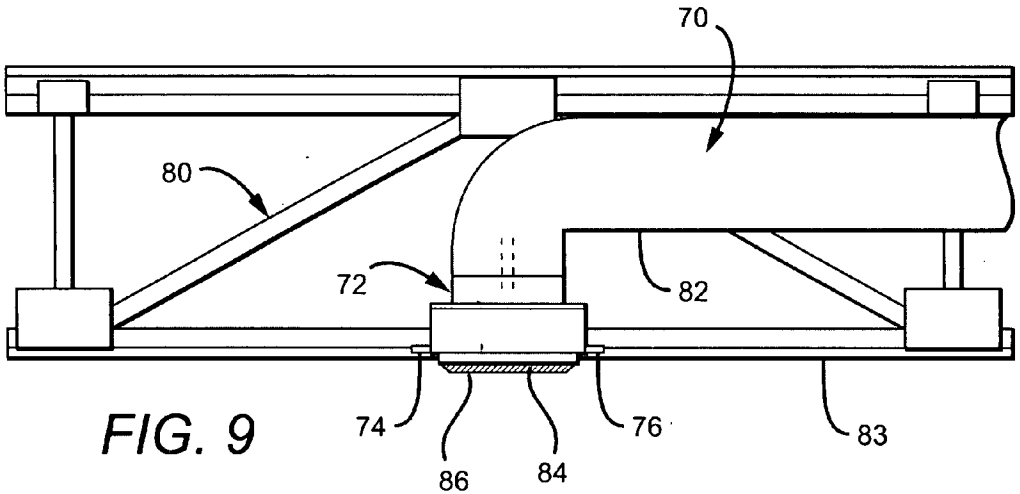
FIG. 9 is a side elevation view of one embodiment of an installed damper according to the present invention with a connected flex duct.
Figure 10:
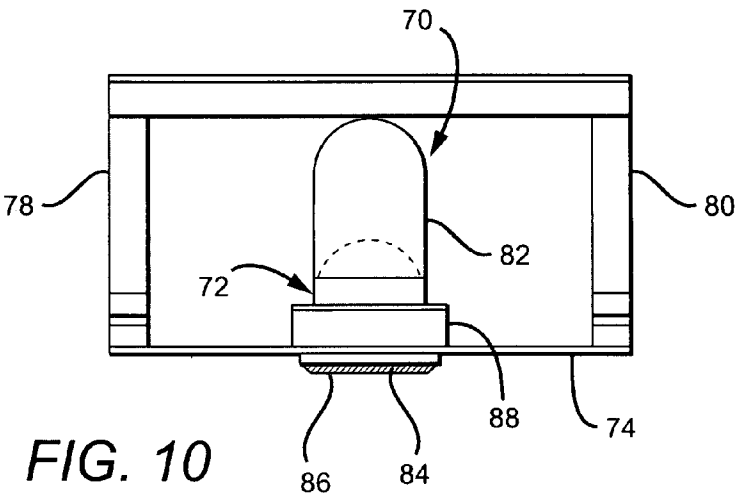
FIG. 10 is a front elevation view of the installed damper shown in FIG. 9.

FIGS. 9 and 10 show part of a ceiling damper system 70 utilizing a damper 72 mounted in a ceiling according to the present invention, although it should be understood that the damper 72 can be used in other systems, such as a simple ventilation system. Boot rails 74,76 are mounted to the damper 72 by mating the lower section lip with the boot rails 74,76 as described above. The damper 72 is then mounted between trusses 78,80 as also described above. The damper 72 is then connected to the HVAC system using a duct 82. Many different conventional ducts 82 can be used, with the preferred duct being flex duct identified as United Laboratories (UL) classified Air Duct Class 0 or Class 1. The duct can be coupled to the damper's damper frame using many different coupling methods, with suitable methods being steel clamp, plastic strap or 18 swg steel wire. Air passing through the duct, either heated or cooled, passes into the damper 72.

RC channels are typically included as part of a ceiling construction and comprise a steel channel that is attached to the structure so that ceiling panels can be attached. This allows the drywall to be supported by, but not rigidly connected to, the structure. Each damper that is installed is considered a ceiling penetration that can compromise the ability of the ceiling to prevent the spread of fire. When installing a damper 72 according to the present invention, ceiling penetrations should be located between adjacent trusses 78, 80 and between RC channels without requiring cuts in the RC channel. If required, one RC channel can be cut to enable proper damper location and installation.

Once the damper 72 is mounted between the trusses 78, 80 on the boot rails 74, 76, ceiling panels 83, such as drywall or gypsum wall board, can be mounted to the RC channel and/or trusses 78, 80 to form the ceiling. A cutout is included in the ceiling material for the bottom opening 84 (also shown as 16 in FIGS. 1–4 and 6) of the damper 72 with the edge of each drywall opening fitting against the edge of the hood damper opening 84. The distance between the edge of the bottom opening and the edge of the cutout in the ceiling material should not exceed approximately ⅛ of an inch on any side. After the ceiling material is installed, a grille 86 can be fastened to the damper, over the bottom opening 84. Many different mounting devices can be used, with a preferred mounting device being No. 8 screws. The grille 86 is typically mounted by securing it to the lower section 88 of the damper so the ceiling material is sandwiched between the grille 86 and the lower section 88.

In operation, the HVAC system 70 provides heated or cooled air to a room by first passing the air into the duct 82. The air then passes into the room through the damper 72. If a fire breaks out in the room below the damper or in the structure around the damper 72, and if the temperature around the damper exceeds the melting temperature for the fuse holding the blades open, the fuse will separate and the blades will close. This closes the damper and prevents most air from passing through it, which effectively restores the ability of the ceiling to prevent the spread of fire by blocking the hole created for the damper.

Although the present invention has been described in considerable detail with reference to certain preferred configurations, other versions are possible. Therefore, the spirit and scope of the appended claims should not be limited to the preferred variations described above.

We claim:

1. A ceiling damper system, comprising:

a damper housing having an inlet opening to accept air from a heating, ventilation and air conditioning (HVAC) system, and an outlet opening to supply the HVAC air to a room;

a damper mechanism to substantially block the flow of air through said damper housing when the temperature around said housing reaches a predetermined level;

two or more cross members, each of which is mounted between fixed points in a ceiling, said cross members arranged to support and hold said damper housing, each of said cross members comprising one or more substantially horizontal surfaces, and said damper housing comprising two or more substantially horizontal surfaces, wherein said damper housing rests on said cross members with said damper housing horizontal surfaces on said cross member horizontal surfaces, wherein each of said cross members is elongated and said damper housing comprises a lower section, each of said cross members running along a respective lower edge of said lower section, wherein each of said members comprises a boot rail with an S-shaped cross section having a first curved section and a flat section, each edge of said lower section having an edge lip that fits within the first curved section of its respective cross member.

2. A method for mounting a ceiling damper, comprising:

providing a ceiling damper having a damper housing for accepting air from a heating, ventilation and air conditioning HVAC system and providing the HVAC system air to a room;

mounting at least two cross members across fixed points in a room ceiling in a position to support said damper housing;

arranging said damper housing on said cross members so that a substantially horizontal surface of said damper rests on a substantially horizontal surface of said cross members and is affixed to said cross members in a position to provide HVAC air to the room, wherein each of said cross members comprises a boot rail with an S-shaped cross section having a first curved section and a flat section, each edge of said lower section having an edge lip that fits within the first curved section of its respective cross member and said bottom section resting on said flat section.; and providing HVAC system air to said ceiling damper.

3. The ceiling damper system of claim 1, wherein the ceiling comprises components from the group consisting of trusses, joists and TJI beams, said cross members mounted to said ceiling components.

4. The ceiling damper system of claim 3, wherein said cross members are mounted to a lower surface of said ceiling components.

5. The ceiling damper system of claim 3, wherein said trusses are parallel, said cross members mounted between adjacent ceiling components.

6. The ceiling damper system of claim 5, wherein said cross members are mounted transverse to said adjacent ceiling components.

7. The ceiling damper system of claim 1, wherein said lower section is mounted to said cross sections by mating each cross member with its respective lower edge that it runs along.

8. The ceiling damper system of claim 7, wherein each of said cross members comprises a first curved section, and wherein each edge of said lower section that mates with each of said cross members comprises an edge lip that mates with its cross member's curved section.

9. The ceiling damper system of claim 1, wherein said damper mechanism comprises a single or plurality of damper blades that are held open to allow the HVAC air to pass and are closed to block the HVAC air.

10. The ceiling damper system of claim 9, further comprising a spring and a fuse link, said spring urging said blades to close, said fuse link holding said blades in open, said fuse link releasing said blades when the temperature around said damper reaches said predetermined level, allowing said blades to close.

11. The ceiling system of claim 1, further comprising a flexible HVAC duct connected to said inlet opening to supply HVAC air to said damper housing.

12. The method of claim 2, further comprising the step of said ceiling damper blocking air passing through said damper housing when the air around said damper housing reaches a predetermined level.

13. The method of claim 2, wherein said damper housing comprises a damper mechanism to substantially block the flow of air through said damper housing when the temperature around said housing reaches a predetermined level.

14. The method of claim 2, wherein each of said cross members is elongated and said damper housing comprises a lower section, each of said cross members running along a respective lower edge of said lower section.

15. The method of claim 2, wherein said ceiling comprises ceiling components from the group consisting of trusses, joists, TJI beams, the mounting of at least two cross members across fixed points comprises mounting said cross members to said ceiling components.

16. The method of claim 15, wherein said cross members are mounted transverse to said ceiling components.

17. The method of claim 14, wherein said lower section is affixed to said cross members by mating each of said cross members with its respective lower edge that it runs along.

18. The method of claim 13, wherein said damper mechanism comprises one or more damper blades that are held open to allow the HVAC air to pass and are closed to block the HVAC air.

19. The method of claim 18, further comprising a spring and a fuse link, said spring urging said blades to close, said fuse link holding said blades in open, said fuse link releasing said blades when the temperature around said damper reaches said predetermined level, allowing said blades to close.

* * * * *

US007125332C1

(12) EX PARTE REEXAMINATION CERTIFICATE (9326th)

United States Patent
Beaver et al.

(10) Number: US 7,125,332 C1
(45) Certificate Issued: Oct. 3, 2012

(54) CEILING RADIATION DAMPER AND MOUNTING METHOD

(75) Inventors: Michael Robert Beaver, Keller, TX (US); Patrick Alan Cockrum, Westlake, TX (US)

(73) Assignee: PCI Industries, Inc., Fort Worth, TX (US)

Reexamination Request:
No. 90/011,585, Mar. 21, 2011

Reexamination Certificate for:

| | |
|---|---|
| Patent No.: | **7,125,332** |
| Issued: | **Oct. 24, 2006** |
| Appl. No.: | **10/746,012** |
| Filed: | **Dec. 23, 2003** |

(51) Int. Cl.
*A62C 2/12* (2006.01)

(52) U.S. Cl. ..... 454/369; 454/257

(58) Field of Classification Search ..... None
See application file for complete search history.

(56) References Cited

To view the complete listing of prior art documents cited during the proceeding for Reexamination Control Number 90/011,585, please refer to the USPTO's public Patent Application Information Retrieval (PAIR) system under the Display References tab.

*Primary Examiner* — Glenn K. Dawson

(57) ABSTRACT

A ceiling damper system that comprises a damper housing having an input opening to accept air from a heating, ventilation and air conditioning HVAC system, and an output opening to supply the HVAC air to a room. The system further comprises a damper mechanism to substantially block the flow of air through the damper housing when the temperature around the housing reaches a predetermined level. Two or more cross members are included, each of which is mounted between fixed points in the ceiling in a position to allow the cross members to support and hold the damper housing. The damper housing rests on the cross members and is mounted to the cross members. A method for mounting a ceiling damper that comprises providing a ceiling damper having a damper housing for accepting air from a HVAC system and providing the HVAC system air to a room. It further comprises mounting at least two cross members across fixed points in a room ceiling in a position to support the damper housing. It then comprises arranging the damper housing on the cross members so that the damper rests on the cross members and is affixed to the cross members in a position to provide HVAC air to the room. HVAC system air is then provided to the ceiling damper.

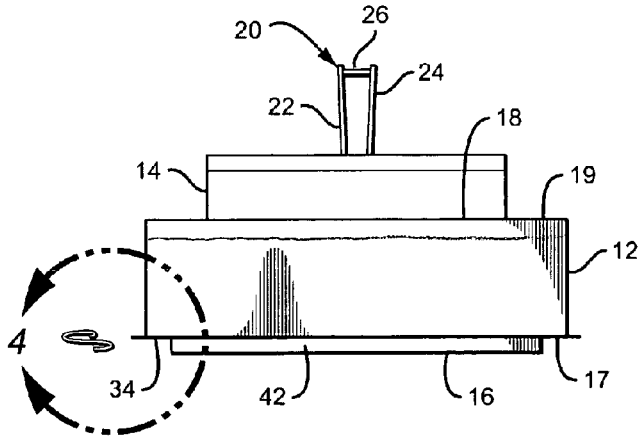

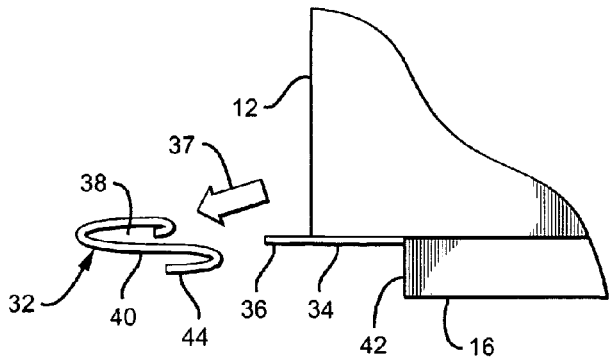

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-19 are cancelled.

* * * * *